US005138383A

United States Patent [19]

Shiga et al.

[11] Patent Number: 5,138,383

[45] Date of Patent: Aug. 11, 1992

[54] APPARATUS FOR USING SUPERCONDUCTIVITY

[75] Inventors: Shoji Shiga; Kiyoshi Yamada; Takayuki Sano, all of Tokyo, Japan

[73] Assignee: The Furukawa Electric Co., Ltd., Tokyo, Japan

[21] Appl. No.: 545,469

[22] Filed: Jun. 28, 1990

[30] Foreign Application Priority Data

Jul. 6, 1989 [JP] Japan ..... 1-175273

[51] Int. Cl.[5] ..... H01F 1/00

[52] U.S. Cl. ..... 335/216; 335/301

[58] Field of Search ..... 323/360; 335/216, 296, 335/301, 302; 29/599; 505/879

[56] References Cited

FOREIGN PATENT DOCUMENTS 0138270 4/1985 European Pat. Off. .
0298461 1/1989 European Pat. Off. .
52-58497 5/1977 Japan ..... 335/216
1-149405 6/1987 Japan ..... 335/216
62-214603 9/1987 Japan ..... 335/216
1-76705 3/1989 Japan ..... 335/216
1-157504 6/1989 Japan .

OTHER PUBLICATIONS

Article entitled "Magnetic Shielding Using High-Tc Superconductor", by Takeo Hattori, et al., printed in Journal of Applied Physics, vol. 27, No. 6, Jun. 1988, pp. L-1120-L-1122.

*Primary Examiner*—Leo P. Picard
*Assistant Examiner*—Trinidad Korka
*Attorney, Agent, or Firm*—Frishauf, Holtz, Goodman & Woodward .

[57] ABSTRACT

An apparatus for using superconductivity intended to increase its critical current density by locating not a superconductor of the metallic type but another superconductor of the ceramic type on the side of high magnetic field in a cryostat. According to this constitution, the apparatus provides higher current density (JC) and better in performance.

6 Claims, 2 Drawing Sheets

APPARATUS FOR USING SUPERCONDUCTIVITY

BACKGROUND OF THE INVENTION

1. Field of the Invention

The present invention relates to an apparatus intended to use superconductivity and suitable for use as electric power, transportation, mechanical power, high energy and electronic machines.

2. Description of the Related Art

Practical applications are known of machines and other apparatus relying on superconductivity, and each housing a superconductor of the metallic type selected from NbTi, NbZr, $Nb_3Sn$, $V_3Ga$, $Nb_3(GeAl)$, Nb, Pb, Pb - Bi and the like and cooled by liquid helium (which will be hereinafter referred to as L - He). Such applications include, for example, energy and signal transmission lines such as power and communication coaxial cables; rotary machines such as the motor and generator; magnet-using machines such as the transformer, SMES (Superconducting Magnetic Energy Storage), accelerator, electromagnetic propulsion train and ship and magnetic separator; magnetic shields; electronic circuits; elements and sensors which can be cited as concrete examples of the superconductivity-using apparatuses or machines.

Each of these superconductivity-using apparatuses or machines often uses a single superconductor. There has also been developed the high-bred magnet wherein two kinds of superconductors which are NbTi and $Nb_3Sn$ or NbTi and $V_3Ga$ are used as a part of the small-sized magnet and the superconductor of $Nb_3Sn$ or $V_3Ga$, higher in critical magnetic field, is located on the side of high magnetic field.

The superconductivity-using apparatuses or machines can use a large amount of high density current and they can also be operated under the condition that their electric resistance value is zero or under permanent current mode. It can be therefore expected that they are made smaller in size and save energy to a greater extent. There has also been developed the superconductor of the ceramic type which can be used under the cooling condition of relatively high temperature realized by liquid nitrogen (which will be hereinafter referred to as L - N) or the like cheaper than L - He.

However, the conventional superconductivity-using apparatuses or machines had the following drawbacks.

1) Extremely low temperature realized by L - He is essential. This makes the apparatuses or machines complicated in structure and it is therefore difficult to make them small in size. Further, they are expensive and have a limitation in their use.

It is therefore desired that an apparatus, smaller in size, having a higher ability and new other functions is realized. If the superconductivity-using apparatuses or machines can be made smaller in size, their heat flowing area will become smaller. This enables their refrigerating capacity to be reduced to a greater extent.

2) As compared with the metal superconductor, the ceramic superconductor is 1/10–1/100 or still lower than these values in the carrier density of superconducting current. Therefore, its grain boundary barrier is larger and its coherent length is shorter. This makes it impossible for the ceramic superconductor to obtain a current density high enough to be used for industrial machines. Particularly because of its thermal fluctuation and flux creep caused under high temperature, it cannot create a stable superconducting condition.

SUMMARY OF THE INVENTION

An object of the present invention is to provide an apparatus for using superconductivity, higher in critical current density (Jc) and better in performance.

Another object of the present invention is to provide a superconductivity-using apparatus, smaller in size, lighter in weight and significantly more useful for industrial purposes.

A superconductivity-using apparatus of the present invention is characterized in that a superconductor of the ceramic type is located at high magnetic field area in a cryostat while another superconductor of the metallic type is located at a low magnetic field area in the cryostat.

The ceramic superconductor may be connected in series to or electrically separated from the metal superconductor.

NbTi, NbZr, $Nb_3Sn$, $V_3Ga$, $Nb_3(GeAl)$, Nb, Pb and Pb - Bi can be used as the metal superconductor.

The Bi group (critical temperature (Tc): 80–110K) of $LnBa_2Cu_3O_7$ (Ln represents a rare-earth element such as Y. Critical temperature (Tc): 90–95K), $Bi_2Sr_2Ca_1Cu_2O_8$, and $Bi_2Sr_2Ca_2Cu_3O_{10}$ and the Tl group (critical temperature (Tc): 90–125K) of $TlBa_2Ca_2Cu_3O_{10}$ and $TlBa_2CaCu_2O_{6.5}$ can be used as the ceramic superconductor.

The ceramic superconductor has a critical temperature higher than that of the metal superconductor.

The cryostat is set to have a temperature same as that of L - He in many cases because it is cooled in accordance with the critical temperature (Tc) of the metal superconductor. In other words, it is used under excessively-cooled condition with regard to the ceramic superconductor which has a higher critical temperature.

The reason why the metal superconductor is located at low magnetic field area while the ceramics superconductor is located at a high magnetic field area in the case of an apparatus of the present invention is as follows:

The critical current density (Jc) and capacity of the metal superconductor are quite limited in a high magnetic field. NbTi has a flux density of 8T (Tesla) and $Nb_3Sn$ and $V_3Ga$ have a flux density of about 15T at 4.2K, for example. When a superconductor which is crystal-oriented paying attention to its anisotropy is selected as the ceramic superconductor, however, it can have a critical current density (Jc) equal or close to that of the metal even if its flux density is higher than 2–20T or particularly in a range of 2–15T at 4.2K. However, its critical current density (Jc) cannot be improved in a low magnetic field whose flux density is particularly in a range of 2–15T. This characteristic becomes more peculiar as compared with the case of the metal superconductor. It is supposed that this phenomenon is caused by the fact that the carrier density of the ceramic superconductor is low and also by some other reasons. According to a superconductivity-using apparatus of the present invention, therefore, the metal superconductor is located at low magnetic field area while the ceramic superconductor at high magnetic field area so as to raise the critical current density (Jc) to the highest extent.

The above-described characteristic of the present invention becomes remarkable particularly when the ceramic superconductor is crystal-oriented in such a way that the C axis is in a direction right-angled relative to magnetic field generated. This is because the crystal anisotropy of the ceramic superconductor is stronger and because the critical magnetic field, for example, generated in a direction perpendicular to the C axis is 5–50 times larger than the critical one generated in a direction parallel to the C axis. This ceramic superconductor is therefore the so-called two-dimensional one. The critical current density (Jc) of a superconductor product which includes this superconductor as a component or magnetic field generated by a solenoid coil in which this superconductor is used depends greatly upon the crystal orientation of this superconductor.

DETAILED DESCRIPTION OF THE PREFERRED EMBODIMENTS

Example 1

Figure 1:
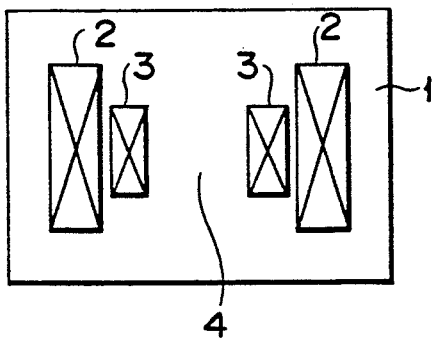
FIG. 1 is a vertically-sectioned view showing a magnet which is an example 1 of the superconductivity-using apparatus according to the present invention.

FIG. 1 is a vertically-sectioned view showing a magnet which is an example of the superconductivity-using apparatus according to the present invention.

In FIG. 1, reference numeral 1 represents a cryostat cooled by L - He. A pair of solenoid coils 2 and 2 which are superconductors of the metallic type are located at certain areas in the cryostat 1 and opposed to each other with a certain interval interposed. Another pair of ceramic coils 3 and 3 which are superconductors of the ceramic type are located at those certain areas between the solenoid coils 2 and 2 which are lower in magnetic field than the solenoid-coils-located areas in the cryostat 1.

The solenoid and ceramic coils 2, 2 and 3, 3 are excited by an exciting power source (not shown) and severs as magnets.

The solenoid coils 2 and 2 are high-bred ones made of $Nb_3Sn$ or NbTi and $Nb_3Sn$.

Each of the ceramic coils 3 and 3 is housed in a metal skin and made by a superconductor wire rod tape of the Si group in which its crystal C axis is oriented in the radius direction of the rod.

According to the magnet having the above-described arrangement, magnetic field equal to or higher than 2–20T can be generated in a space 4 between the coils in the cryostat 1. The electromagnetic action of the magnet is proportional to the magnetic field which is generated. In order to obtain the same electromagnetic action as that of the conventional magnet, therefore, our magnet can be made significantly smaller in size than the conventional one. When our magnet is the same in size as the conventional one, it can obtain a greater electromagnetic action than that of the conventional one. In other words, our magnet can be used in those fields where the conventional ones could not be practically used. In addition, the economy of cooling the cryostat 1 by L - He can be improved to a greater extent.

It may be arranged that the solenoid coils 2 and 2 are connected to one exciting power source and that the ceramic coils 3 and 3 to another exciting power source; or the solenoid coils 2, 2 may be connected in series to the ceramic ones 3, 3 and then to a common exciting power source for the purpose of reducing the number of the power sources used.

The solenoid and ceramic coils 2, 2 and 3, 3 are provided with lead means such as leads and electrodes for connecting them to a power source or power sources.

Example 2

Figure 2:
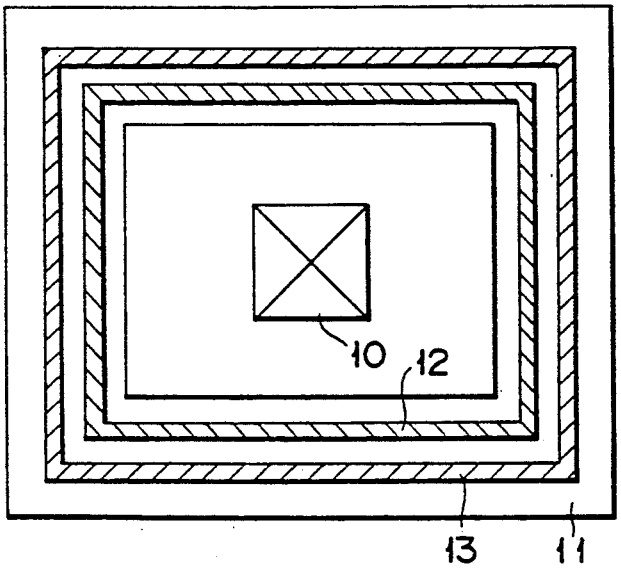
FIG. 2 is a horizontally-sectioned view showing a magnetic shield which is an example 2 of the superconductivity-using apparatus according to the present invention.

FIG. 2 is a horizontally-sectioned view showing a magnetic shield which is an example of the superconductivity-using apparatus according to the present invention.

In FIG. 2, reference numeral 10 denotes a high magnetic field generating magnet suitable for use with the electromagnetic propulsion ship, as an accelerator and the like. In order to prevent the electromagnetism of the magnet 10 from adding harmful influence to human beings and matters outside, it is shielded twice in a cryostat 11 by a shield 12 made of a superconductor of the ceramic type and another shield 13 made of a superconductor of the metallic type. The cryostat 11 is of the type cooled by L - He.

The shield 12 is located at high magnetic area or nearer the high magnetic field generating magnet 10 in the cryostat 11. More specifically, the shield 12 shields most of that magnetism which is generated by the magnet 10, and its low magnetism such as trapped magnetic field is shielded by the shield 13.

In the case of this superconductivity-using apparatus, shielding action results from shielding current under high magnetic field. When the shield 12 is a superconductor of the ceramic type, therefore, it can be made thinner to thereby make the whole of the apparatus smaller in size and lighter in weight.

The superconductor of the ceramic type has grain boundaries and internal flaws inherent in ceramics and because of magnetic flux trapped by them, it is not easy for the superconductor to achieve complete shielding action. It is therefore preferable that the shield 13 which is the superconductor of the metallic type is located at the low magnetic field area in the cryostat 11.

The superconductor of the metallic type in the example 2 is made of Nb or NbTi while the one of the ceramic type is a film-like matter of the Bi or T group formed on a ceramic or metal.

The high magnetic field generating magnet 10 is provided with lead means (not shown) such as leads and electrodes for connecting it to a power source of power sources.

Example 3

Figure 3:
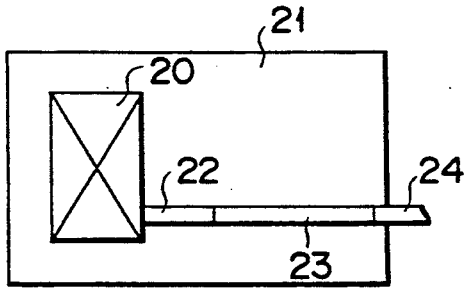
FIG. 3 shows a ferromagnetic field generating magnet which is an example 3 of the superconductivity-using apparatus according to the present invention.

FIG. 3 shows a ferromagnetic field generating magnet 20 which is an example of the superconductivity using apparatus according to the present invention. The magnet 20 is housed in a cryostat 21 cooled by L - He, and has a current lead means for successively connecting a superconductor 22 of the ceramic type, a superconductor 23 made of metal such as NbTi, Nb or the like, and lead 24 in this order. One end of the leads 24 extend outside the cryostat 21.

The superconductor 22 of the ceramic type is located at high magnetic field area or nearer the magnet 20 in the cryostat 21.

In the case of the magnet 20 having the above-described arrangement, the superconductor 23 of the metallic type is located at low magnetic field area in the cryostat 21. This can prevent the quenching of the superconductor 23 in magnetic field and make it unnecessary to further compose and stabilize the superconductor 23 with Cu, Al and the like. The whole of the apparatus can be thus made smaller in size.

Example 4

Powder of $Bi_2O_3$, $SrCO_3$ and CuO having an average grain radius of 5μm and a purity of 99.99% were mixed at a rate of 2(Bi) : 2(Sr) : 1.1(Ca) : 2.1(Cu) and virtually burned at 800° C. for 10 hours in atmosphere. The product thus made was ground until it came to have an average grain radius of 2.5μm and a virtually-burned powder was thus made. The virtually-burned powder was filled in a pipe made of Ag and having an outer diameter of 16 mm and an inner diameter of 11 mm and the pipe thus filled with the powder was sealed at both ends thereof. It was then swaged and metal-rolled to a tape-like wire rod, 0.2 mm thick and 5 mm wide. The process of making a superconducting oxide coil of this tape-like wire rod will be described below.

Figure 4:
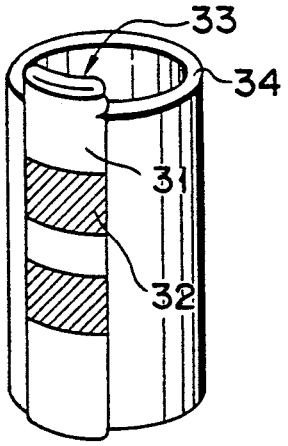
FIGS. 4 through 6 show the process of making a superconducting oxide coil which is an example 4 of the superconductivity-using apparatus according to the present invention.
Figure 5:
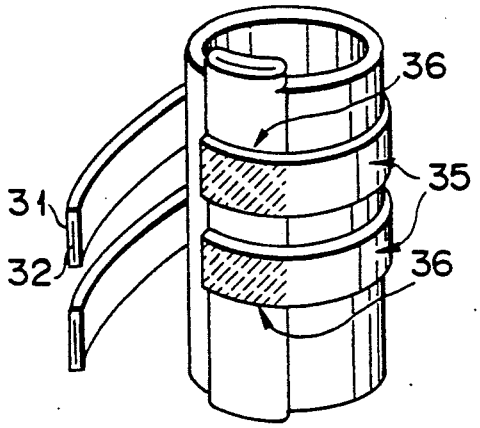
Figure 6:
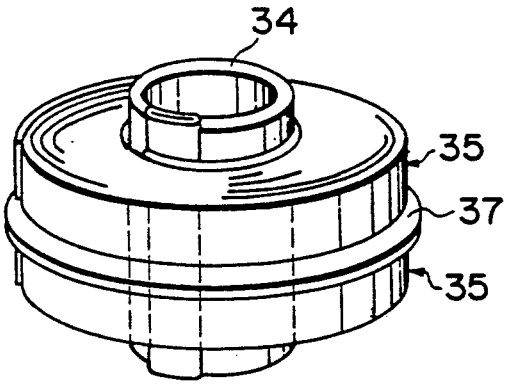

FIGS. 4 through 6 show the process of making an example 4 of the present invention. In these FIGS. 4 through 6, reference numeral 33 represents a current supply lead and 35 coil conductors. A short piece, 50 mm long, was cut from the tape-like wire rod. An Ag coating layer 31, 5 mm wide, was removed from one side of the short piece at those positions separated by 15 mm from both ends of the short piece to expose a superconducting oxide layer 32. The current supply lead 33 was thus made. It was fitted into a groove on a core 34 made by SUS to keep its one side, from which the Ag coating layer 31 was removed, same in level as the outer circumference of the core 34 (FIG. 4). The remaining tape-like wire rod was divided into two coil conductors 35 and the Ag coating layer, 5 mm wide, was removed from one side of an end 35 of each of the coil conductors 35 to expose the under layer of the superconducting oxide matter. These exposed portions of the coil conductors 35 were contacted with the two exposed portions of the current supply lead 33 and the Ag coating layers around these exposed portions were welded and connected to seal the superconducting oxide matters therein (FIG. 5). The two coil conductors 35 were then wound round the core 34 to form a double pancake coil formation having an outer diameter of 120 mm and an inner diameter of 40 mm. A tape, 0.05 mm thick and 5 mm wide, of long alumina filaments braided and a Hastelloy tape, 0.1 mm thick and 5 mm wide, were interposed as insulating and reinforcing materials between the adjacent windings of the coil conductor 35. In addition, an insulating plate 37 made of porous alumina was interposed between the pancake coils (FIG. 6).

10 units of these double pancake coil formations were piled one upon the others. This double pancake coil product was heated at 920° C. for 0.5 hours and then at 850° C. for 100 hours in a mixed gas ($Po_2$, 0.5 atms) of $N_2$- $O_2$. After it was cooled, epoxy resin was vacuum-impregnated into the long-alumina-filaments-braided tape and then hardened to form an oxide superconductor.

This oxide superconductor coil was arranged in a magnet made by an $Nb_3Sn$ superconductor and having a bore radius of 130 mmϕ. The $Nb_3Sn$ wire rod had $12\times10^3$ filaments of $Nb_3Sn$ each being made according to the bronze manner and having a diameter of 5 μϕ. The wire rod was stabilized with Cu and used as a wire rod of 2 mmϕ.

The magnet was glass-insulated and then formed as coil according to the wind and react manner. It was heated at 650° C. for four days.

The whole of the coil was cooled by liquid of 4.2K. When current of 1200A was applied to the external $Nb_3Sn$ coil, magnetic fields of 13T and 4.5T, that is, high magnetic field having a total of 17.5T could be generated.

A part of the Bi tape wire rod was cut off and the Ag sheath was peeled off from the Bi tape wire rod thus cut. X-ray diffraction was applied to a wide face of the tape and many of (00l) peaks were detected. The crystal orientation factor of the C axis was calculated using the following equations (1) and (2).

$$P=\Sigma I(00l) / \Sigma I(hkl) \quad (1)$$

$$Fc=Po-Poo / 1-Poo \quad (2)$$

wherein Poo represents the diffraction strength ratio of the C axis not oriented, Po the diffraction strength ratio of the wire rod which is the example 4 of the present invention, and Fc the crystal orientation factor. Fc was equal to 96% and the C axis was substantially vertical to the tape face. Therefore, the C axis was almost perpendicular to magnetic fields generated by the $Nb_3Sn$ and Bi coils.

As apparent from the examples 1 - 4, the ceramic and metal superconductors are used as a combination of them. In addition, the ceramic superconductor is located at high magnetic field area while the metal superconductor at low magnetic field area. Critical current density (Jc) can be thus increased to enhance the performance of the superconductivity-using apparatus. This enables the apparatus to be made smaller in size, lighter in weight and extremely more useful for industrial purposes.

What is claimed is:

1. An apparatus for utilizing superconductivity, comprising:

a superconductor of the ceramic type located at high magnetic field area in a cryostat; and superconductor of the metallic type located at a low magnetic field area in the cryostat;

wherein the cryostat is cooled by a liquid helium, and the crystal axes of the ceramic superconductor are oriented.

2. The apparatus according to claim 1, wherein the C axis of the magnetic field generating section of the ceramic superconductor is in a direction right-angled in relation to the magnetic field which is generated.

3. The apparatus according to claim 1, wherein the ceramic superconductor is electrically connected to the metal superconductor.

4. The apparatus according to claim 1, wherein the ceramic superconductor is electrically insulated from the metal superconductor.

5. The apparatus according to claim 1, wherein the metal superconductor is at least one of NbTi, NbZr, $Nb_3Sn$, $V_3Ga$, $Nb_3(GeAl)$, Nb, Pb and Pb - Bi.

6. The apparatus according to claim 1, wherein the ceramic superconductor is at least one of $LnBa_2Cu_3O_7$, $Bi_2Sr_2Ca_1Cu_2O_8$, $Bi_2Sr_2Ca_2Cu_3O_{10}$, $Tl_2Ba_2Ca_2Cu_3O_{10}$ and $TlBa_2CaCu_2O_{6.5}$.

* * * * *